US010982920B1

(12) United States Patent
Bailey

(10) Patent No.: US 10,982,920 B1
(45) Date of Patent: Apr. 20, 2021

(54) WIRELESS FIREARM MECHANISM AND ASSOCIATED ACCESSORIES

(71) Applicant: KUDZU ARMS, LLC, Hogansville, GA (US)

(72) Inventor: Christopher G. Bailey, Hogansville, GA (US)

(73) Assignee: KUDZU ARMS, LLC, Hogansville, GA (US)

( * ) Notice: Subject to any disclaimer, the term of this patent is extended or adjusted under 35 U.S.C. 154(b) by 0 days.

(21) Appl. No.: 16/681,272

(22) Filed: Nov. 12, 2019

(51) Int. Cl.
*F41A 19/59* (2006.01)
*F41A 17/06* (2006.01)
*F41A 19/69* (2006.01)

(52) U.S. Cl.
CPC ..... *F41A 19/59* (2013.01); *F41A 17/063* (2013.01); *F41A 19/69* (2013.01)

(58) Field of Classification Search
CPC ..... F41A 19/58; F41A 16/59; F41A 19/63; F41A 19/64; F41A 19/67; F41A 19/46; F41A 9/62; F41A 17/063; F41A 19/69
USPC ..... 89/127, 135
See application file for complete search history.

(56) References Cited

U.S. PATENT DOCUMENTS

| | | | | |
|---|---|---|---|---|
| 4,387,649 | A * | 6/1983 | Weidner | F42C 11/065 102/206 |
| 6,412,207 | B1 | 7/2002 | Crye | |
| 8,397,621 | B2 | 3/2013 | Hodge | |
| 9,791,232 | B1 | 10/2017 | Winge | |
| 2010/0257769 | A1 | 10/2010 | Doll | |
| 2019/0186857 | A1 | 6/2019 | Galie | |
| 2020/0348098 | A1* | 11/2020 | Galie | F41A 19/59 |

FOREIGN PATENT DOCUMENTS

| | | | | |
|---|---|---|---|---|
| CA | 2701446 | A1 * | 10/2011 | F41A 19/59 |
| CN | 207263020 | U | 4/2018 | |
| EP | EU 3569966 | * | 11/2019 | F41A 19/59 |

* cited by examiner

*Primary Examiner* — Stephen Johnson
(74) *Attorney, Agent, or Firm* — Eversheds Sutherland (US) LLP

(57) ABSTRACT

A wireless firearm system is disclosed. The wireless firearm system includes a device computer processor operable to execute a set of computer-readable instructions. Attached to the device computer process is a device memory operable to store the set of computer-readable instructions. The device memory is operable to receive a first set of firearm values from a first firearm transmitter, receive a firing sequence command, and determine a second set of firearm values based at least in part on the firing sequence command. The device memory can determine the first set of firearm values is less than the second set of firearm values and communicate the firing sequence command to a firearm memory.

8 Claims, 6 Drawing Sheets

WIRELESS FIREARM MECHANISM AND ASSOCIATED ACCESSORIES

FIELD OF THE DISCLOSURE

The disclosure generally relates to firearm systems and more particularly relates to a wireless firearm system operable to remotely discharge firearms.

BACKGROUND

Traditional firearms are typically discharged through mechanical actuation from an exterior force acting on the firearm's trigger. For example, the firearm can include a single-stage trigger assembly embedded within the receiver. In a single-stage trigger assembly, an outside force acts on the trigger and causes the trigger to rotate within the trigger guard and receiver. The rotation of the trigger displaces the trigger interface away from the sear on the hammer component. The released sear permits the hammer to quickly rotate to a projectile cartridge primer within the receiver thereby causing discharge of the firearm. Once the projectile is discharged, the hammer swings back to a trigger disconnector, the outside force releases the trigger, and the sear reengages the trigger interface. Although a single-stage trigger assembly is the most common assembly in rifles, many other trigger assemblies can be embedded within a firearm receiver. Each of the trigger assemblies need a physical input to cause actuation of the assembly and discharge of the firearm. Accordingly, there is a need for a remote-controlled trigger assembly.

SUMMARY

Some or all of the above needs and/or problems may be addressed by certain embodiments of the wireless firearm system disclosed herein. According to an embodiment, the wireless firearm system includes a device computer processor operable to execute a set of computer-readable instructions. Attached to the device computer process is a device memory operable to store the set of computer-readable instructions. The device memory is operable to receive a first set of firearm values from a first firearm transmitter, receive a firing sequence command, and determine a second set of firearm values based at least in part on the firing sequence command. The device memory can determine the first set of firearm values is less than the second set of firearm values and communicate the firing sequence command to a firearm memory.

Other features and aspects of the wireless firearm system will be apparent or will become apparent to one with skill in the art upon examination of the following figures and the detailed description. All other features and aspects, as well as other system, method, and assembly embodiments, are intended to be included within the description and are intended to be within the scope of the accompanying claims.

BRIEF DESCRIPTION OF THE DRAWINGS

The detailed description is set forth with reference to the accompanying drawings. The use of the same reference numerals may indicate similar or identical items. Various embodiments may utilize elements and/or components other than those illustrated in the drawings, and some elements and/or components may not be present in various embodiments. Elements and/or components in the figures are not necessarily drawn to scale. Throughout this disclosure, depending on the context, singular and plural terminology may be used interchangeably.

DETAILED DESCRIPTION

Described below are embodiments of systems and methods for wireless communication and control of one or more firearms via a wireless firearm system. The wireless firearm system includes a user device and a firearm equipped with a firearm trigger computing assembly. The user device and the firearm trigger computing assembly are in communication with each other. For example, the user device can transmit, receive, and store information about the firearm equipped with the firearm trigger computing assembly disposed within the firearm. Similarly, the firearm can transmit, receive, and store information about the firearm to and from the user device. The user device and the firearm can operably communicate to remotely discharge the firearm at a given discharge rate, with a particular number of projectiles, and at a particular time interval (e.g., collectively referred to herein as a firearm sequence command). In this manner, a user can remotely operate the firearm in a variety of sequences and durations. In some instances, the user device may be in communication with a number of firearms equipped with a firearm trigger computing assembly.

These and other embodiments of the disclosure will be described in more detail through reference to the accompanying drawings in the detailed description of the disclosure that follows. This brief introduction is provided for the reader's convenience and is not intended to limit the scope of the claims or the proceeding sections. Furthermore, the techniques described above and below may be implemented in a number of ways and in a number of contexts. Several example implementations and contexts are provided with reference to the following figures, as described below in more detail. However, the following implementations and contexts are but a few of many.

Figure 1:
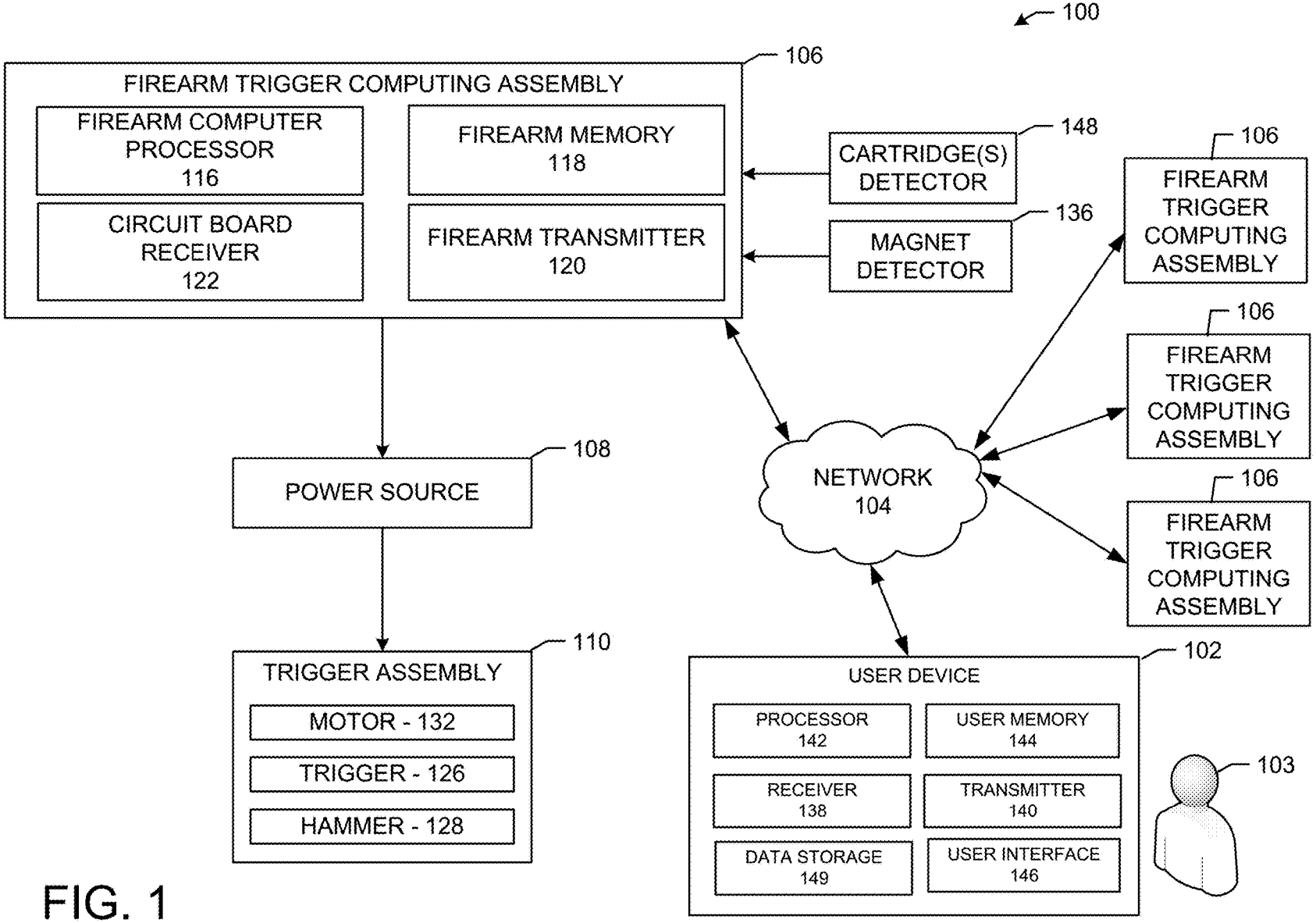
FIG. 1 depicts a wireless firearm system in accordance with one or more embodiments of the disclosure.

FIG. 1 depicts a wireless firearm system 100. The wireless firearm system 100 includes a user device 102, a network 104, and one or more firearm trigger computing assemblies 106. In some instances, the user device 102 receives data (e.g., values, commands, and other information) from a user 103 via the network 104. Similarly, the user device 102 receives data (e.g., values, commands, and other information) from the firearm trigger computing assembly 106 via the network 104. In other instances, the user device 102 and the firearm trigger computing assembly 106 directly communicate data. The user device 102 transmits the data from the user 103 to the network. The network 104 transmits the data to the firearm trigger computing assembly 106. The firearm trigger computing assembly 106 facilitates power, via a power source 108, to a trigger assembly 110 (e.g., a motor, a trigger, etc.) thereby discharging a firearm lower receiver 112 (e.g., as shown in FIG. 2A).

In certain embodiments, the firearm trigger computing assembly 106 and user device 102 communicate one or more values (e.g., default values and user input values). In some instances, the one or more values operably detail characteristics of the firearm and detail command inputs by the user 103. The one or more values include a first value, a second value, and a third value. In other instances, more than three values may communicate between the user device 102 and firearm trigger computing assembly 106. The first value includes a number of projectiles. The second value includes a firearm identification number (e.g., a randomized number or a detailed, specific number identifying a type of firearm). The third value includes a number of projectiles to discharge. One or more values are included in a set of values (e.g., a first set of firearm values, a second set of firearm values). For example, the first value and the second value are included in the first set of firearm values. The second set of values can include one or more of the values disclosed herein. In some instances, the user 103 may input a set of values (e.g., a firing sequence command) via the user device 102. Other values include discharge rates, lists of discharge rates, and time intervals.

Firearm and Firearm Trigger Computing Assembly

Figure 2A:
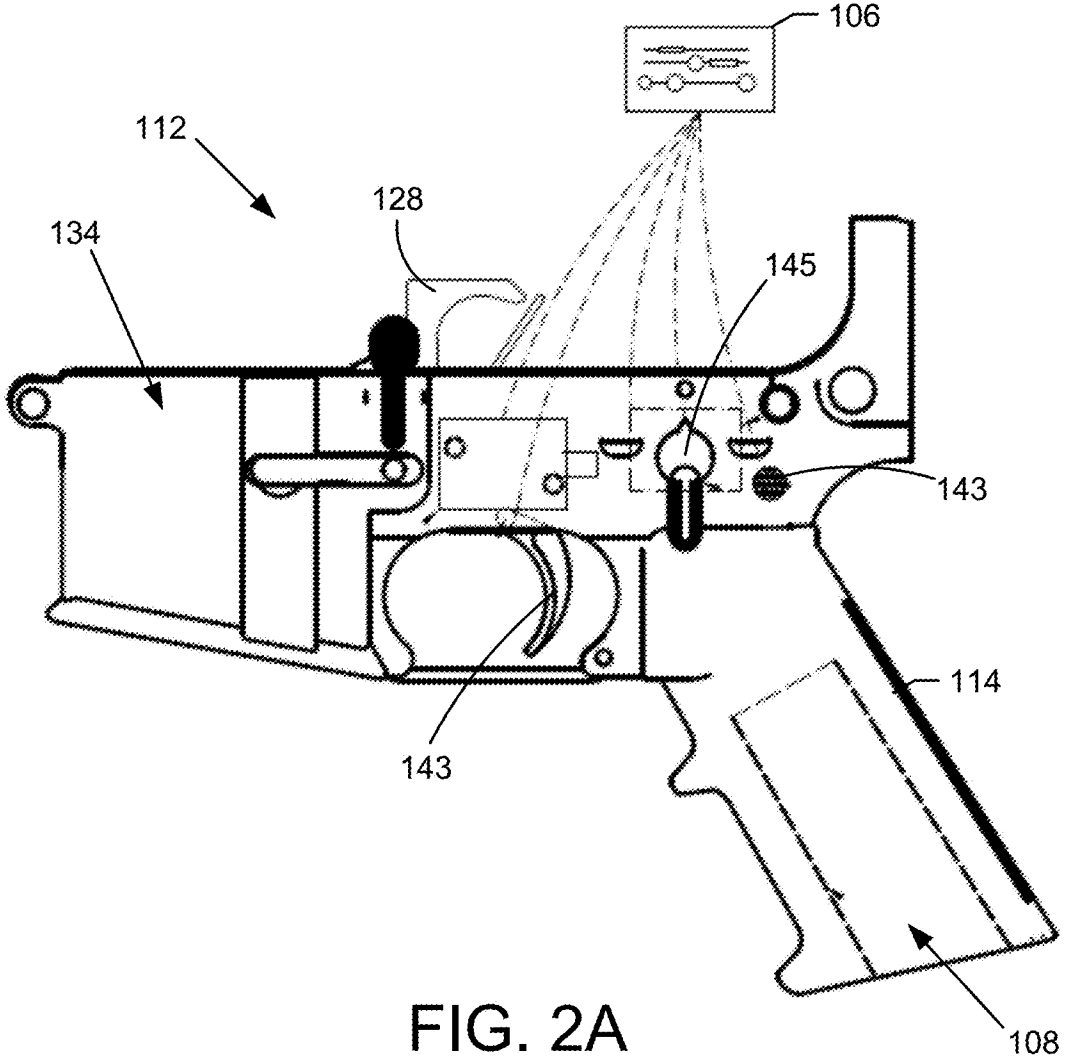
FIG. 2A depicts a first view of a lower receiver of the wireless firearm system in accordance with one or more embodiments of the disclosure.
Figure 2B:
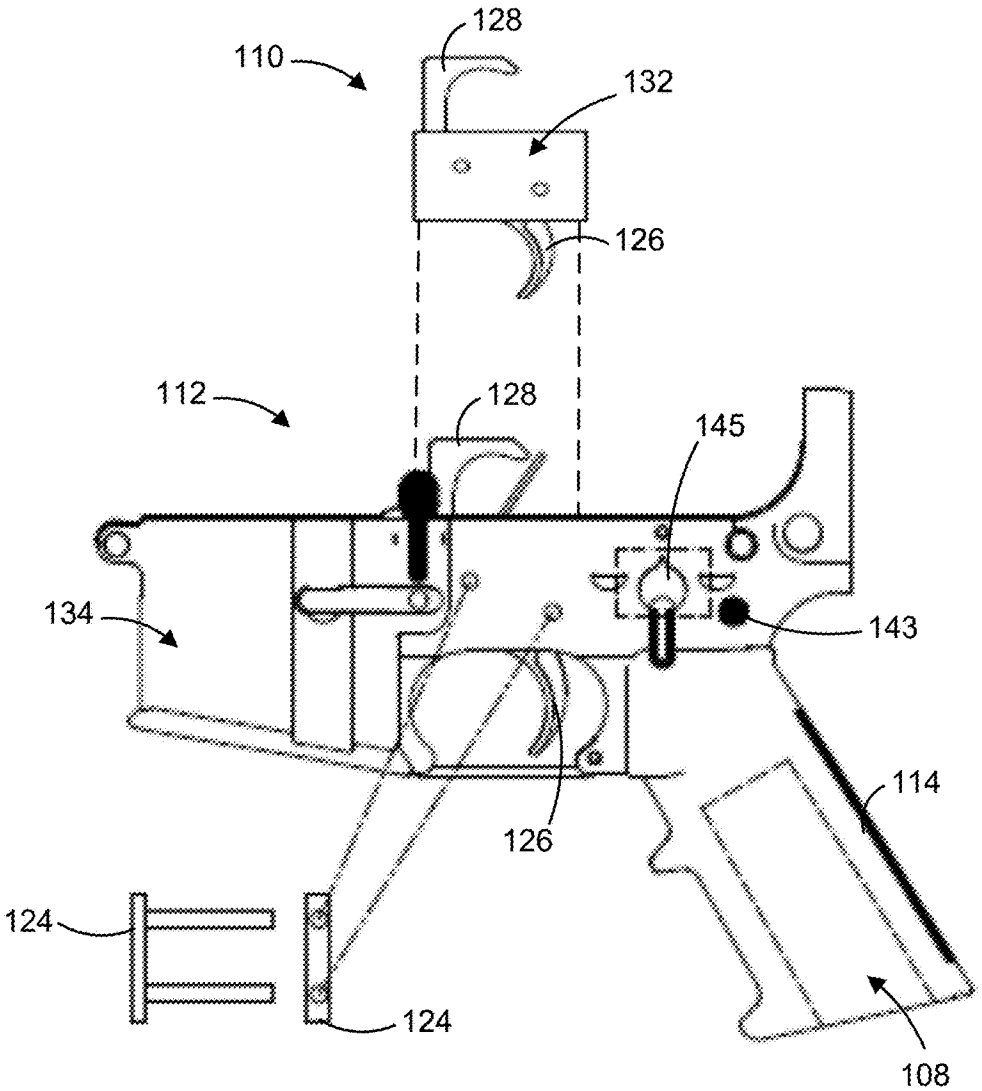
FIG. 2B depicts a second view of the lower receiver of the wireless firearm system in accordance with one or more embodiments of the disclosure.

FIGS. 2A and 2B depict the firearm lower receiver 112 and a grip 114 of the wireless firearm system 100. The firearm lower receiver 112 and grip 114 may be of a conventional firearm. For example, one of the firearms within the system may include an M-16 style rifle, an AR-15 style rifle, an AR-10 style rifle, an M-4 style rifle, or any firearm that includes a hammer and trigger configuration/geometry that is similar to that of an AR, among others. The other firearms within the system may include a variation of other AR-style firearms. Each of the firearms may include a rail system to mount accessories, such as a tripod and optic. Any of the components or systems described herein can be interchangeable onto an original equipment manufacturer's firearm (e.g., modifying the OEM firearm lower receiver for the lower receivers described herein), including non-civilian weapons.

The wireless firearm system 100 includes the firearm trigger computing assembly 106. In some instances, the firearm trigger computing assembly 106 includes a firearm computer processor 116 (as referred to as a computer) operable to execute a set of computer readable instructions and a firearm memory 118 operable to store the set of computer-readable instructions. The firearm computer processor 116 and memory 118 are disposed within the firearm lower receiver 112. In other instances, the firearm computer processor 116 and memory 118 are disposed within other components of the firearm, such as the butt stock, upper receiver, or on an exterior surface of the firearm. The firearm computer processor 116 and memory 118 may communicate with the network 104 and/or the user device 102 via a firearm transmitter 120. The firearm transmitter 120 is configured to send signals (e.g., radio signal) to the network 104 and/or user device 102. The firearm computer processor 116 may receive data from the network 104 and/or the user device 102 via a circuit board receiver 122 or the like.

Figure 5:
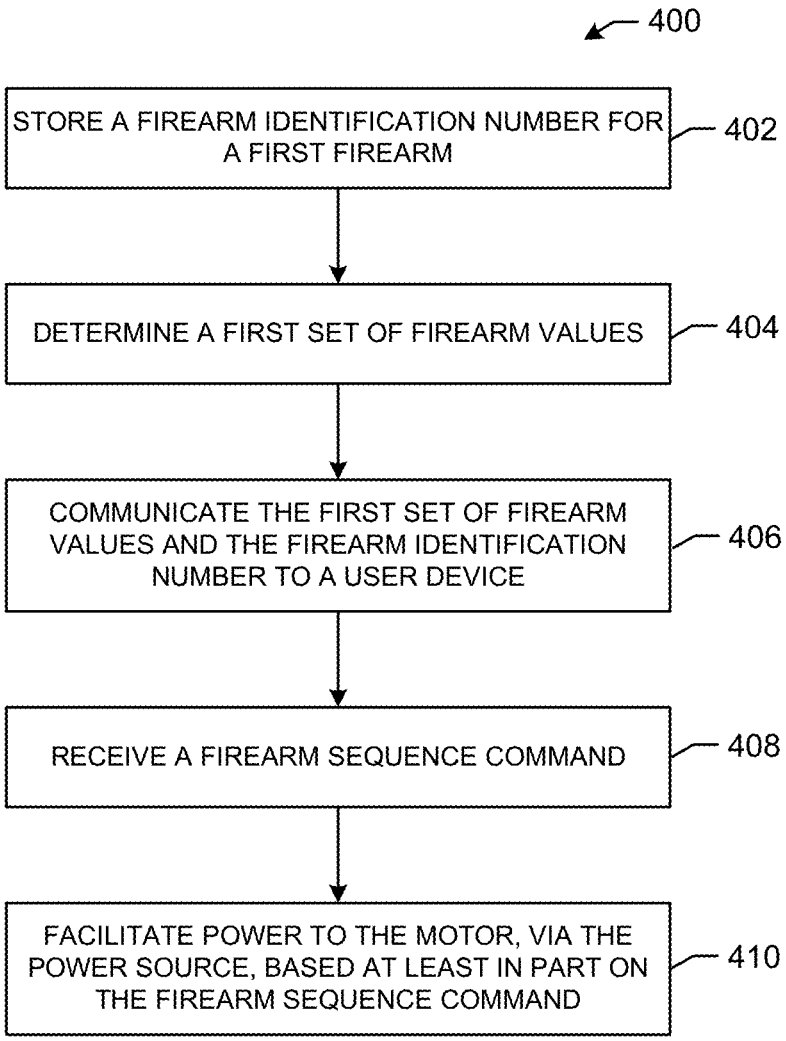
FIG. 5 depicts an example process flowchart for a firearm trigger computing assembly in accordance with one or more embodiments of the disclosure.

The at least one firearm memory 118 includes a set of computer-executable instructions that can be executed by the at least one firearm computer processor 116 (e.g., one process shown in FIG. 5). The instructions include storing a firearm identification number associated with one firearm. In some instances, the firearm identification number signifies the type and characteristics of firearm (e.g., caliber, length of barrel, range, etc.). The instructions include determining a first set of firearm values. The first set of firearm values includes a first value based at least in part on the number of projectiles disposed within a magazine and a second value based at least in part on the number of firearm identification numbers. The instructions include communicating the first set of firearm values and the firearm identification number to the user device 102 (e.g., user memory, user device receiver 138, etc.). The instructions include receiving a firearm sequence command (e.g., discharge rate, a number of projectiles, a time interval). The instructions include facilitating power to an actuator, e.g., a motor or the like, via the power source 108, based at least in part on the firearm sequence command.

The firearm trigger computing assembly 106 of the firearm is in communication with the trigger assembly 110 (e.g., as shown in FIG. 2B). The dashed lines represent the method of attaching particular components to the firearm lower receiver 112. The trigger assembly 110 and firearm trigger computing assembly 106 is anchored within the firearm lower receiver 112 by a two-pin tool 124. The trigger assembly 110 and firearm trigger computing assembly 106 may anchor on the firearm by another fastener, including hook and loop, screw, adhesive, or detent. In some instances, the trigger assembly 110 may include a trigger 126, a hammer 128 abutting the trigger 126 via a biasing mechanism 130, and a motor (not shown) attached to the trigger 126. The motor is a magnetic ram solenoid. In other instances, the motor is an electric motor. The motor may cause centripetal, pulsating, or some other type of movement thereby actuating the trigger 126 and/or hammer 128 of the trigger assembly 110. In other embodiments, the motor and biasing mechanism may be a spring powered trigger (e.g., compression spring or tension spring) in communication with the firearm trigger computing assembly. In this manner, the firearm trigger computing assembly may receive instruction to discharge the firearm. The computing assembly then sends power to the motor to actuate the firearm trigger. In certain embodiments, the trigger assembly 110 includes a fire control module configured to alternate between firing modes. The firearm modes operate via a firearm safety selector (e.g., as shown in FIG. 2A). Firearm modes may include a semi-automatic mode, a burst mode, and an automatic mode. Each mode permits and/or restricts a discharge rate by trigger assembly 110. Semi-automatic mode is one discharged projectile per trigger pull. Burst mode is a set limit on the number of discharged projectiles per trigger pull. Automatic permits continuous discharge of projectiles as the trigger 126 is pulled. The firearm trigger computing assembly 106 may communicate the discharge rate to the network 104 and/or user device 102. Any one of the embodiments described herein can alternate between manual discharge (e.g., user actuation of the trigger) and electronic discharge via the firearm trigger computing assembly.

The firearm trigger computing assembly 106 of the firearm is in communication with a power source 108 disposed within the grip 114 of the firearm (e.g., as shown in FIG. 2B). The power source 108 includes a battery. The battery may include lithium-ion, lead-acid, nickel-metal hydride, or nickel cadmium. The motor is in communication with the power source 108. In this manner, the firearm computer processor 116 and memory may receive the firearm sequence command from the user device 102, facilitate the power source 108 to send current to the motor, and the motor actuates the trigger assembly 110 to discharge a projectile in accordance with the firearm sequence command.

As depicted in FIGS. 2A and 2B, the firearm lower receiver 112 includes a magazine well 134 and a magnet detector (not shown) within the magazine well 134. The magnet detector communicates with the firearm computer processor (e.g., wirelessly or hardwired). The firearm includes a magazine (not shown) with a magnet disposed on the magazine. In this manner, the magnet detector alerts the firearm computer processor when the magazine engages with the firearm. In some instances, the magazine includes a cartridge (also referred to herein as projectile) detector (not shown). The cartridge detector operably counts the number of cartridges within the magazine. In some instances, the computer-executable instructions and data storage discussed herein stores the number of cartridges for particular firearms and the associated magazine (e.g., the computer-executable instructions and data storage assume a full magazine with the maximum number of cartridges therein). The number of cartridges discharged is then subtracted from the original number of cartridges for the firearm and associated magazine. The cartridge detector communicates the number of cartridges to the firearm trigger computing assembly 106. In some instances, the number of cartridges is communicated to the user device 102 to place limits on input values by the user 103. In other instances, the cartridge detector communicates a warning to the firearm trigger computing assembly 106 as the number of cartridges reaches zero. The cartridge detector may communicate a warning at any given interval of cartridges (e.g., 1, 5, or 10 cartridges remaining in the magazine). In yet other instances, the firearm lower receiver 112 includes a status indicator light 143 in communication with the cartridge detector. The status light indicator may flash at a given interval of cartridge remaining in the magazine. For example, the status indicator light may flash when 1, 5, or 10 cartridges remain in the magazine. Once the magazine empties, the cartridge detector may communicate a discharge error. The firearm trigger computing assembly 106 may communicate the discharge error to the user device 102 when cartridges are empty or the lower receiver is jammed.

In certain embodiments, the firearm may include a keypad (not shown). For example, the keypad includes a keypad processor and keypad memory configured to lock the firearm trigger computing assembly 106. In this manner, the keypad restricts the operation of the firearm until a sequence code is entered into the keypad. In other instances, the keypad includes a grip sensor configured to receive input such as pressure or fingerprints of a user 103.

User Device and Network

As shown in FIG. 1, the user device 102 of the wireless firearm system 100 includes a wireless device operable by a user 103. For example, the device may include, a laptop, tablet computer, portable gaming device, smart phone, cellular phone, or other mobile communication device configured to transmit and receive communications. The device may wirelessly communication with other devices, such as the firearm described herein. The communication protocol of the wireless device may include WI-FI, BLUETOOTH®, third generation cellular (3G), Long Term Evolution (LTE), near-field communication, or other variation of wireless communication. In some embodiments, the wireless device may operably include an inlet/outlet component to engage a wired connection with the firearm.

The wireless firearm system 100 includes the user device 102, operable by the user 103, in communication with the network 104 and/or firearm trigger computing assembly 106. Any of user devices 102 and firearm trigger computing assemblies 106 may be configured to communicate with each other and any other component of the system via one or more networks. The network 104 may include, but is not limited to, any one or a combination of different types of suitable communications networks such as, for example, cable networks, public networks (e.g., the Internet), private networks, wireless networks, cellular networks, or any other suitable private and/or public networks. Further, the network 104 may have any suitable communication range associated therewith and may include, for example, global networks (e.g., the Internet), metropolitan area networks (MANs), wide area networks (WANs), local area networks (LANs), or personal area networks (PANs). In addition, the network may include any type of medium over which network traffic may be carried including, but not limited to, coaxial cable, twisted-pair wire, optical fiber, a hybrid fiber coaxial (HFC) medium, microwave terrestrial transceivers, radio frequency communication mediums, satellite communication mediums, or any combination thereof. The user device 102 includes a user device receiver 138 and user device transmitter 140 to communicate with the network 104 and/or firearm trigger computing assembly 106.

As shown in FIG. 1, the user device 102 includes at least one user device computer processor 142 and at least one user device memory 144 including a set of computer-executable instructions. The instructions can be executed by the at least one processor, and the instructions include receiving the first set of firearm values from the first firearm transmitter. The first set of firearm values include the first value based at least in part on the number of projectiles disposed within a magazine, and the second value based at least in part on the number of firearm identification numbers. The instructions include receiving the firing sequence command from a user interface discussed herein. The instructions include determining a second set of firearm values based at least in part on the firing sequence command. The instructions include determining the first set of firearm values is less than the second set of firearm values. For example, the number of projectiles within the magazine is less than the number of projectiles specified by the firing sequence command. The instructions include communicating the firing sequence command to the firearm trigger computing assembly 106.

Figure 3:
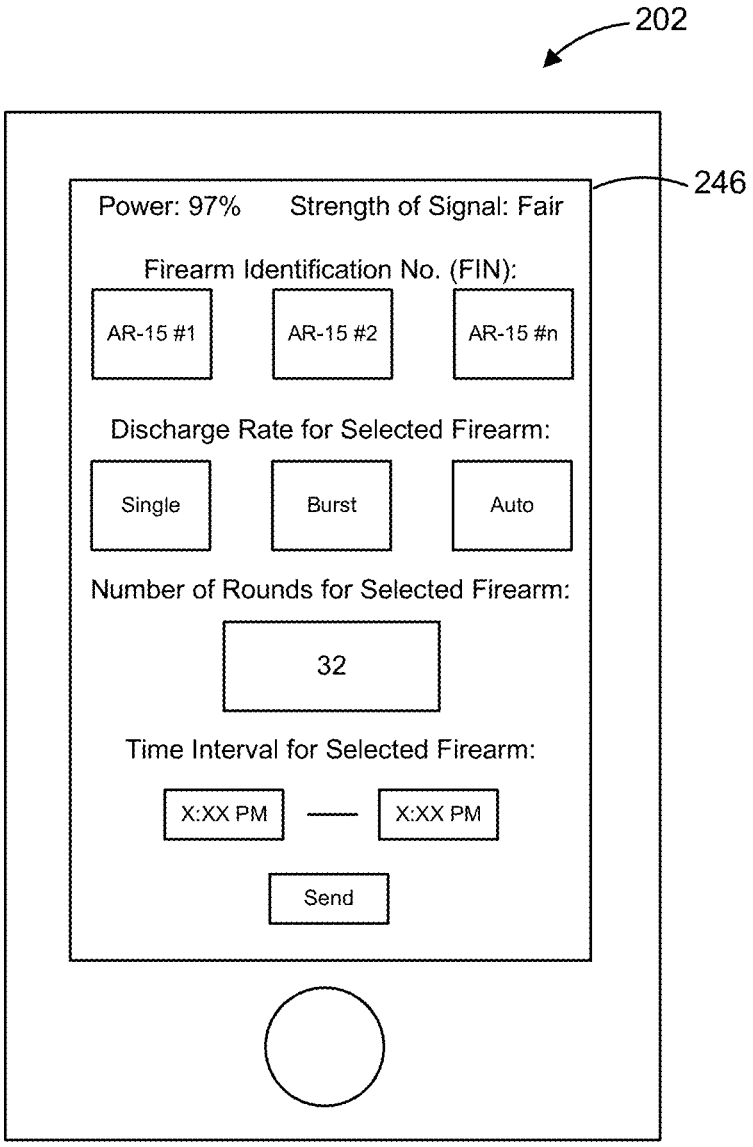
FIG. 3 depicts a user interface of the wireless firearm system in accordance with one or more embodiments of the disclosure.

FIG. 3 depicts one example of a user interface 246 of the wireless firearm system 100. The user interface, displayed on the user device 202, includes one or more values. The one or more values operably detail characteristics of the wireless firearm system 100 and detail command inputs for the user. The one or more values include the first value, the second value, and the third value. In some instances, more than three values may display on the user device 202. The first value may include the number of projectiles available. The second value may include the firearm identification number transmitted from the firearm trigger computing assembly (e.g., from the firearm transmitter). The third value may include the number of projectiles to discharge. One or more values may bundle into one or more sets of values (e.g., a first set of firearm values, a second set of firearm values). In some instances, the user device includes a send command configured to transmit the firearm sequence command to the firearm trigger computing assembly. In this manner, the firearm sequence command includes the inputs by the user of the one or more values in which the firearm trigger computer assembly executes discharge of the firearm.

As discussed herein, the user device 102 includes one or more user device computer processors 142 that may include any suitable processing unit capable of accepting digital data as input, processing the input data based on stored computer-executable instructions, and generating output data. In some instances, the user device 102 includes a data storage 149. The computer-executable instructions may be stored, for example, in the data storage 149 and may include, among other things, operating system software and application software. The computer-executable instructions may be retrieved from the data storage 149 and loaded into the memory 144 as needed for execution. The processor may be configured to execute the computer-executable instructions to cause various operations to be performed. Each processor may include any type of processing unit including, but not limited to, a central processing unit, a microprocessor, a microcontroller, a Reduced Instruction Set Computer (RISC) microprocessor, a Complex Instruction Set Computer (CISC) microprocessor, an Application Specific Integrated Circuit (ASIC), a System-on-a-Chip (SoC), a field-programmable gate array (FPGA), and so forth.

The data storage may store program instructions that are loadable and executable by the processors, as well as data manipulated and generated by one or more of the processors during execution of the program instructions. The program instructions may be loaded into the memory as needed for execution. Depending on the configuration and implementation of the user device 102, the memory may be volatile memory (memory that is not configured to retain stored information when not supplied with power) such as random access memory (RAM) and/or non-volatile memory (memory that is configured to retain stored information even when not supplied with power) such as read-only memory (ROM), flash memory, and so forth. In various implementations, the memory may include multiple different types of memory, such as various forms of static random access memory (SRAM), various forms of dynamic random access memory (DRAM), unalterable ROM, and/or writeable variants of ROM such as electrically erasable programmable read-only memory (EEPROM), flash memory, and so forth.

Various program modules, applications, or the like may be stored in data storage that may comprise computer-executable instructions that when executed by one or more of the processors cause various operations to be performed. The memory may have loaded from the data storage one or more operating systems (O/S) that may provide an interface between other application software (e.g., dedicated applications, a browser application, a web-based application, a distributed client-server application, etc.) executing on the server computing device and the hardware resources of the server computing device. More specifically, the O/S may include a set of computer-executable instructions for managing the hardware resources of the server computing device and for providing common services to other application programs (e.g., managing memory allocation among various application programs). The O/S may include any operating system now known or which may be developed in the future including, but not limited to, any mobile operating system, desktop or laptop operating system, mainframe operating system, or any other proprietary or open-source operating system.

The data storage includes computer-executable instructions for supporting functionality. For example, the data storage may include one or more applications. The user device 102 can include computer-executable instructions that in response to execution by one or more processors cause the firearm trigger computing assembly to facilitate discharging the firearm. The operations may also include receiving the first set of firearm values from the first firearm transmitter. The operations may also include receiving a firing sequence command from the user. The operations may also include determining a second set of firearm values based at least in part on the firing sequence command. The operations may also include determining the first set of firearm values is less than the second set of firearm values. The operations may also include communicating the firing sequence command to a firearm trigger computing assembly or firearm memory.

Figure 4:
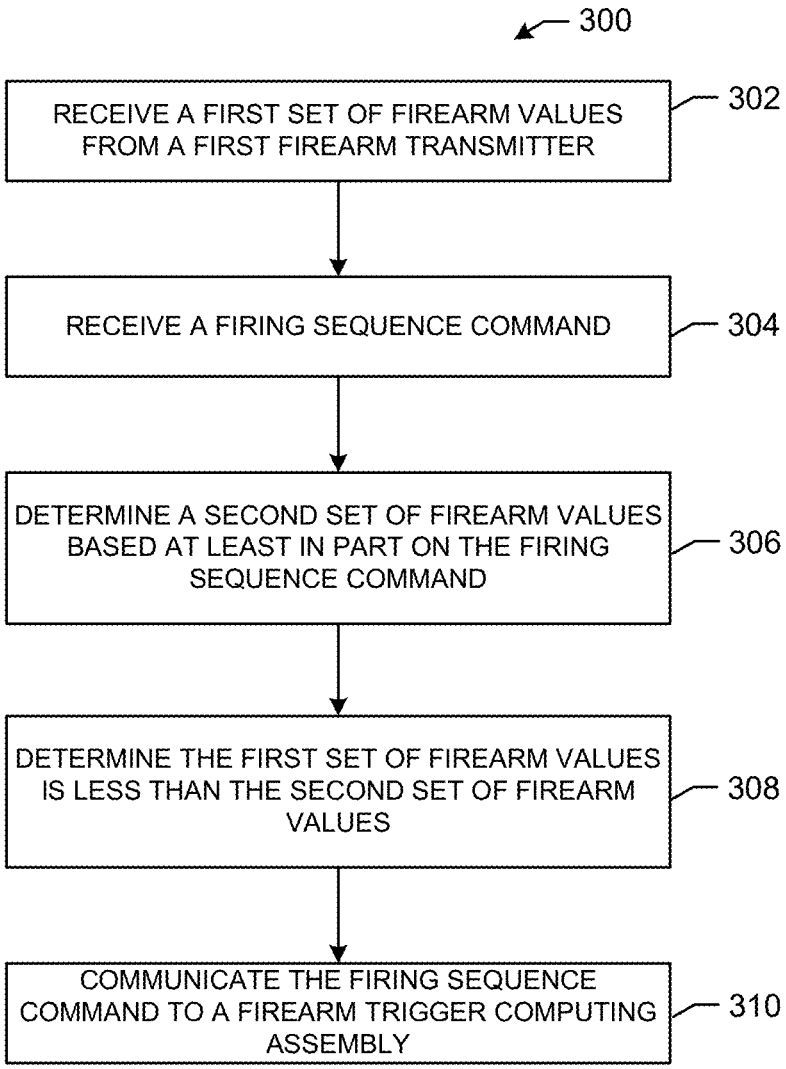
FIG. 4 depicts an example process flowchart for a user device in accordance with one or more embodiments of the disclosure.

FIG. 4 is a flow diagram depicting an illustrative method 300 for communicating a firing sequence command from the user device to the firearm trigger computing assembly. At block 302, the user device receives a first set of firearm values from a first firearm transmitter. At block 304, the user device receives a firing sequence command. For example, the user device may receive the firing sequence command from user input via the user interface. At block 306, the user device determine a second set of firearm values based at least in part on the firing sequence command. At block 308, the user device determines the first set of firearm values is less than the second set of firearm values. In this manner, the first set of firearm values may include the number of projectiles loaded into the firearm, and the second set of firearm values may include the number of projectiles the user determines to discharge from the firearm. At block 310, the user device communicates the firing sequence command to the firearm trigger computing assembly.

FIG. 5 is a flow diagram depicting an illustrative method 400 for the firearm trigger computing assembly communicating with the user device. At block 402, the firearm trigger computing assembly stores the firearm identification number for the firearm. The firearm identification number may correspond to a make and model of firearm (e.g., DANIEL DEFENSE®V7®). At block 404, the firearm trigger computing assembly determines the first set of firearm values. At block 406, the firearm trigger computing assembly communicates the first set of firearm values and the firearm identification number to the user device. At block 408, the firearm trigger computing assembly receives a firearm sequence command from the user device and/or network 104. At block 410, the firearm trigger computing assembly facilitates power to the motor, via the power source, based at least in part on the firearm sequence command.

Those of skill in the art will appreciate that any of the components of the wireless firearm system 100 and associated architecture may include alternate and/or additional hardware, software, or firmware components beyond those described or depicted without departing from the scope of the disclosure. More particularly, it should be appreciated that hardware, software, or firmware components depicted or described as forming part of any of the illustrative components of the wireless firearm system 100, and the associated functionality that such components support, are merely illustrative and that some components may not be present or additional components may be provided in various embodiments. While various program modules have been depicted and described with respect to various illustrative components of the wireless firearm system 100, it should be appreciated that the functionality described as being supported by the program modules may be enabled by any combination of hardware, software, and/or firmware. It should further be appreciated that each of the above-mentioned modules may, in various embodiments, represent a logical partitioning of supported functionality. This logical partitioning is depicted for ease of explanation of the functionality and may not be representative of the structure of hardware, software, and/or firmware for implementing the functionality. Accordingly, it should be appreciated that the functionality described as being provided by a particular module may, in various embodiments, be provided at least in part by one or more other modules. Further, one or more depicted modules may not be present in certain embodiments, while in other embodiments, additional modules not depicted may be present and may support at least a portion of the described functionality and/or additional functionality. Further, while certain modules may be depicted and described as sub-modules of another module, in certain embodiments, such modules may be provided as independent modules.

Those of skill in the art will appreciate that the wireless firearm system 100 is provided by way of example only. Numerous other operating environments, system architectures, and device configurations are within the scope of this disclosure. Other embodiments of the disclosure may include fewer or greater numbers of components and/or devices and may incorporate some or all of the functionality described with respect to the wireless firearm system 100, or additional functionality.

Portions of the disclosure described above can be with reference to block and flow diagrams of systems, methods, apparatuses, and/or computer program products according to example embodiments of the disclosure. It will be understood that one or more blocks of the block diagrams and flow diagrams, and combinations of blocks in the block diagrams and the flow diagrams, respectively, can be implemented by computer-readable program instructions. Likewise, some blocks of the block diagrams and flow diagrams may not necessarily need to be performed in the order presented, or may not necessarily need to be performed at all, according to some embodiments of the disclosure.

Various block and/or flow diagrams of systems, methods, apparatus, and/or computer program products can be described with respect to the above example embodiments of the disclosure. It will be understood that one or more blocks of the block diagrams and flow diagrams, and combinations of blocks in the block diagrams and flow diagrams, respectively, can be implemented by computer-readable program instructions. Likewise, some blocks of the block diagrams and flow diagrams may not necessarily need to be performed in the order presented, or may not necessarily need to be performed at all, according to some embodiments of the disclosure.

These computer-executable program instructions may be loaded onto a special purpose computer or other particular machine, a processor, or other programmable data processing apparatus to produce a particular machine, such that the instructions that execute on the computer, processor, or other programmable data processing apparatus create means for implementing one or more functions specified in the flow diagram block or blocks. These computer program instructions may also be stored in a computer-readable memory that can direct a computer or other programmable data processing apparatus to function in a particular manner, such that the instructions stored in the computer-readable memory produce an article of manufacture including instruction means that implement one or more functions specified in the flow diagram block or blocks. As an example, embodiments of the disclosure may provide for a computer program product, comprising a computer-usable medium having a computer-readable program code or program instructions embodied therein, said computer-readable program code adapted to be executed to implement one or more functions specified in the flow diagram block or blocks. The computer program instructions may also be loaded onto a computer or other programmable data processing apparatus to cause a series of operational elements or operations to be performed on the computer or other programmable apparatus to produce a computer-implemented process such that the instructions that execute on the computer or other programmable apparatus provide elements or operations for implementing the functions specified in the flow diagram block or blocks.

Accordingly, blocks of the block diagrams and flow diagrams support combinations of means for performing the specified functions, combinations of elements or operations for performing the specified functions and program instruction means for performing the specified functions. It will also be understood that each block of the block diagrams and flow diagrams, and combinations of blocks in the block diagrams and flow diagrams, can be implemented by special purpose, hardware-based computer systems that perform the specified functions, elements or steps, or combinations of special purpose hardware and computer instructions.

Although specific embodiments of the disclosure have been described, numerous other modifications and alternative embodiments are within the scope of the disclosure. For example, any of the functionality described with respect to a particular device or component may be performed by another device or component. Further, while specific device characteristics have been described, embodiments of the disclosure may relate to numerous other device characteristics. Further, although embodiments have been described in language specific to structural features and/or methodological acts, it is to be understood that the disclosure is not necessarily limited to the specific features or acts described. Rather, the specific features and acts are disclosed as illustrative forms of implementing the embodiments. Conditional language, such as, among others, "can," "could," "might," or "may," unless specifically stated otherwise, or otherwise understood within the context as used, is generally intended to convey that certain embodiments could include, while other embodiments may not include, certain features, elements, and/or steps. Thus, such conditional language is not generally intended to imply that features, elements, and/or steps are in any way required for one or more embodiments.

That which is claimed is:

1. A wireless firearm system comprising:

a user device comprising a memory and processors operable to:

receive a first set of firearm values from a first firearm transmitter;

receive a firing sequence command;

determine a second set of firearm values based at least in part on the firing sequence command;

determine the first set of firearm values is less than the second set of firearm values; and communicate the firing sequence command to a firearm trigger computing assembly.

2. The wireless firearm system of claim 1, further comprising a firearm comprising:

a firearm lower receiver, wherein the firearm trigger computing assembly disposed within the firearm lower receiver;

a magazine well disposed within the firearm lower receiver; and a magnet detector embedded within the magazine well.

3. The wireless firearm system of claim 2, further comprising a magazine comprising a magnet.

4. The wireless firearm system of claim 1, further comprising receiving a firearm identification number corresponding to a first firearm.

5. The wireless firearm system of claim 4, wherein:

a first value of the first set of firearm values is based at least in part on a number of projectiles disposed within a magazine; and a second value of the first set of firearm values is based at least in part on a number of firearm identification numbers.

6. The wireless firearm system of claim 1, wherein the firing sequence command comprises:

a third value based at least in part on a number of projectiles to discharge from each firearm;

a discharge rate for each firearm; and a time interval, the time interval comprising a first time and a second time.

7. The wireless firearm system of claim 6, wherein the firing sequence command is received via a user interface.

8. The wireless firearm system of claim 1, further comprising receiving a discharge error from the first firearm transmitter.

* * * * *